US012022894B2

(12) United States Patent
Thomas

(10) Patent No.: US 12,022,894 B2
(45) Date of Patent: Jul. 2, 2024

(54) COMPRESSION GARMENT WITH AN INTEGRATED RECEPTACLE

(71) Applicant: Andrew Thomas, Chicago, IL (US)

(72) Inventor: Andrew Thomas, Chicago, IL (US)

( * ) Notice: Subject to any disclaimer, the term of this patent is extended or adjusted under 35 U.S.C. 154(b) by 293 days.

(21) Appl. No.: 17/693,050

(22) Filed: Mar. 11, 2022

(65) Prior Publication Data

US 2022/0287392 A1 Sep. 15, 2022

Related U.S. Application Data

(60) Provisional application No. 63/159,688, filed on Mar. 11, 2021.

(51) Int. Cl.

| | |
|---|---|
| ***A45F 3/20*** | (2006.01) |
| ***A41D 13/00*** | (2006.01) |
| *A45F 3/16* | (2006.01) |

(52) U.S. Cl.

CPC ..... *A41D 13/0012* (2013.01); *A41D 2400/46* (2013.01); *A45F 2003/166* (2013.01)

(58) Field of Classification Search

CPC ..... B67D 2210/00131; Y10S 383/906; A45F 2003/166; A45F 2003/163; A45F 3/16; A45F 3/20; A45F 2003/003; A41D 2400/46; A41D 13/002; A41D 2003/166; B65D 25/48; B65D 2401/15; B65D 47/10

USPC ..... 224/148.2; 222/153.01, 153.05, 153.06, 222/465.1, 541.1, 541.5, 175

See application file for complete search history.

(56) References Cited

U.S. PATENT DOCUMENTS

| | | | | |
|---|---|---|---|---|
| 4,948,023 | A * | 8/1990 | Tripp | A45F 3/16 224/148.2 |
| 5,147,054 | A * | 9/1992 | Pehr | B65D 51/20 215/253 |
| 5,400,934 | A * | 3/1995 | Ducros | A45F 3/16 224/148.2 |
| 5,722,573 | A * | 3/1998 | Carnel | A45F 3/16 224/148.2 |
| 5,864,880 | A * | 2/1999 | Adam | A45F 3/20 2/108 |
| 11,684,140 | B2 * | 6/2023 | Hassett | A45F 3/16 224/148.2 |

* cited by examiner

*Primary Examiner* — Adam J Waggenspack
(74) *Attorney, Agent, or Firm* — Fraline J. Allgaier

(57) ABSTRACT

A compression garment with an integrated receptacle that provides liquid to a user is disclosed. The compression garment has at least one exterior cavity for receiving a receptacle and at least one tube channel with tube channel openings for receiving the tube from the exterior cavity and to route the tube across the chest of a user and into a webbing loop. An o-ring that locks a breakable foil seal in place is provided when a spout is connected to the neck element and the spout secures the liquid in the reservoir by compressing the o-ring on the foil seal. A grab ridge is then used to release the reservoir from the cavity of the compression garment as desired by the user.

7 Claims, 10 Drawing Sheets

COMPRESSION GARMENT WITH AN INTEGRATED RECEPTACLE

RELATED APPLICATIONS

This application claims priority of U.S. Provisional Patent Application Ser. No. 63/159,688 filed Mar. 11, 2021.

TECHNICAL FIELD

This disclosure relates to a compression garment. More specifically and without restriction to the particular embodiments which are shown and described for purposes of illustration, the present invention relates to a compression garment with an integrated receptacle that provides liquid to a user.

BACKGROUND

In some articles of clothing, receptacles or the like for transporting liquid may be utilized. Such receptacles are disclosed in U.S. Pat. Nos. 4,941,598, 5,060,833, 5,601,207, 5,699,933, 5,911,406, 5,911,406, and 5,924,678. Typically, receptacles are used to house beverages or liquids that can be freely removed from a container.

Release of liquid from these receptacles may be difficult due to poor construction or the removal of parts of the receptacle in order access a protective seal. Some receptacles release liquid with any slight compression or interference with the surface. This thereby denies the user the ability to quickly and accurately use the receptacle as desired. Consumers often select receptacles based on structural convenience, shape, size, and shelf life of the contents. Manufacturers also recognize the packaging benefits of a flexible receptacle, since the receptacle can be formed and filled on the same manufacturing line.

The present inventor herein has provided a receptacle formed of flexible construction and which overcomes many of the disadvantages described above. The receptacle of the present invention is flexible, easy to handle, and facilitates a quick and secure access to the liquid content that is provided therein. More specifically, the receptacle as provided herein can be designed and manufactured in such a manner that after it is prefilled and securely placed in the exterior cavity of a compression garment, the contents remain fresh with a breakable foil seal that can be punctured as desired and secured with a spout that is specifically designed to prevent the spilling of liquid by compressing an o-ring along the perimeter.

The compression garment as provided herein is further characterized with the following novel features: (1) A compression garment with an integrated receptacle that provides a liquid to a user; (2) A reservoir being connected to a neck element and the liquid in the reservoir being secured therein during use of the same by an o-ring locking a breakable foil seal in place when a spout is connected to the neck element; (3) A compression garment having at least one exterior cavity for receiving a receptacle and at least one tube channel with tube channel openings for receiving the tube from the exterior cavity and to route the tube to a webbing loop; (4) The neck element of a receptacle having a grab ridge being adapted to receiving the hands of a user and to release the reservoir from the compression garment.

SUMMARY OF THE INVENTION

In order to accomplish the objects of the present invention, there is provided a compression garment with an integrated receptacle that provides a liquid to a user. The receptacle having a reservoir with a top opening for receiving the liquid, and a neck element with top and bottom neck openings. The neck element having a locking mechanism, a grab ridge, and a breakable foil seal covering the top neck opening to prevent the liquid from leaking from the reservoir. The receptacle further including a spout having a top opening, a bottom opening, and the spout housing a downward extending lever for a locking connection to the locking mechanism of the neck element and an o-ring for locking the breakable foil seal in place. A tube is connected to the top opening of the spout and a bite valve is connected to the tube at a bottom portion thereof.

Another advantage of the present invention is to provide a reservoir being connected to a neck element and the liquid in the reservoir being secured therein during use of the same by an o-ring locking a breakable foil seal in place when a spout is connected to the neck.

Another advantage of the present invention is to provide a compression garment having at least one exterior cavity for receiving a receptacle and at least one tube channel with tube channel openings for receiving the tube from the exterior cavity and to route the tube to a webbing loop.

Another advantage of the present invention is to provide a neck element of a receptacle having a grab ridge being adapted to receive the hands of a user and to release the reservoir from the compression garment.

In a further embodiment, a method of providing a compression garment with an integrated receptacle that provides a liquid to a user is presented.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

The foregoing summary is illustrative only and is not intended to be in any way limiting. In addition to the illustrative aspects, embodiments, and features described above, further aspects, embodiments, and features will become apparent by reference to the drawings and the following detailed description and claims.

DESCRIPTION OF DRAWINGS

The present embodiments are illustrated by way of the figures of the accompanying drawings, which may not necessarily be to scale, in which like references indicate similar elements, and in which.

DETAILED DESCRIPTION OF ILLUSTRATIVE EMBODIMENTS

The following detailed description is a contemplated mode of carrying out a compression garment 10 with an integrated receptacle 12 that provides a liquid 14 to a user. Although the compression garment 10 with an integrated receptacle 12 is explained in relation to attached figures, it is to be understood that many other possible modifications and variations can be made without departing from the spirit and scope of the disclosure. Therefore, a compression garment 10 may be integrated with various types of receptacles including water-proof bags, stretch mesh water receptacle pockets, canteens, pitchers, carafes and the like for releasing liquid through the tube channel 72 of a compression garment 10. The receptacle 12 may be used to release various types of liquids including water, teas, juices, carbonated and non carbonated liquids, soft drinks, milk and the like for consumption while the compression garment 10 is being worn.

It is understood that the compression garment 10 as described herein includes compression sportswear, custom made garments, tight-fitting compression garments, compression therapy garments, burn compression garments, wraps, interim care garments, pressure sleeves, maternity wear, and the like with varying degrees of compression and for improving circulation of body fluids, preventing rashes and chafing, easing muscle stiffness, and facilitating quick recovery after exercise. The compression garment as described herein can be constructed from nylon, spandex, or other breathable durable fabrics and the like to provide the degrees of compression and benefits described herein.

Figure 1:
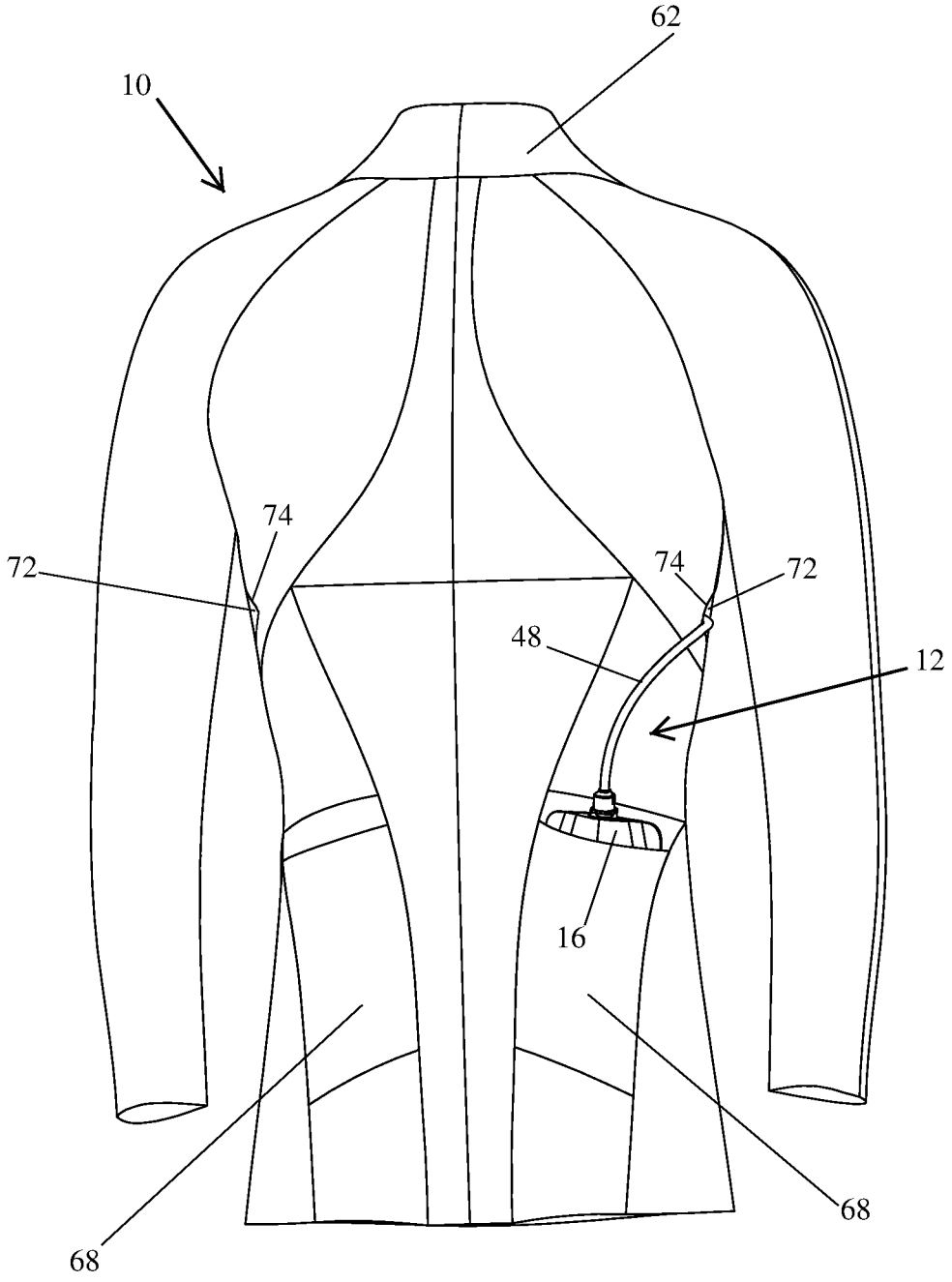
FIG. 1 illustrates an exemplary compression garment with an attached receptacle according to a preferred embodiment.
Figure 2:
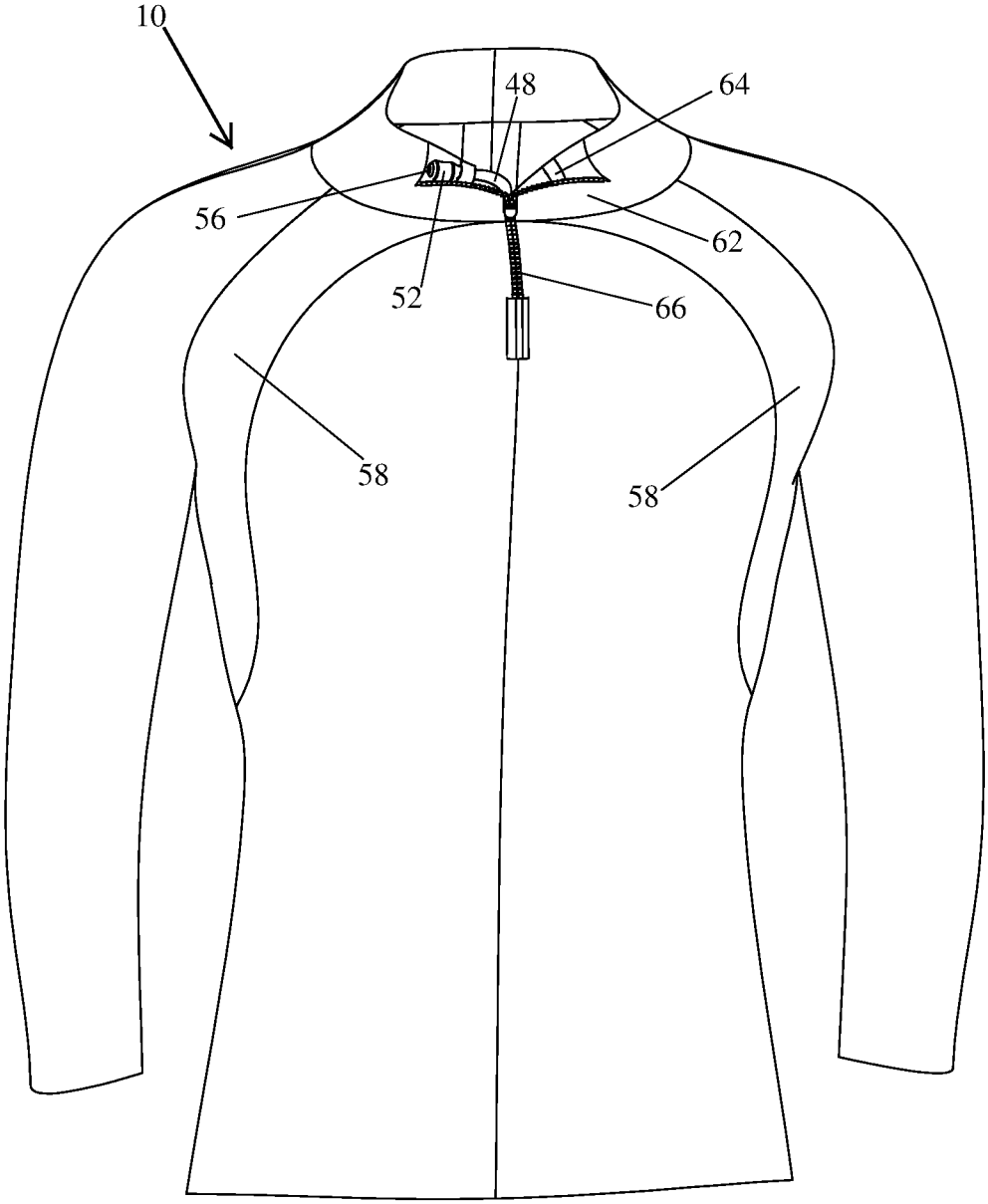
FIG. 2 illustrates a front view of the bite valve in the compression garment.
Figure 3:
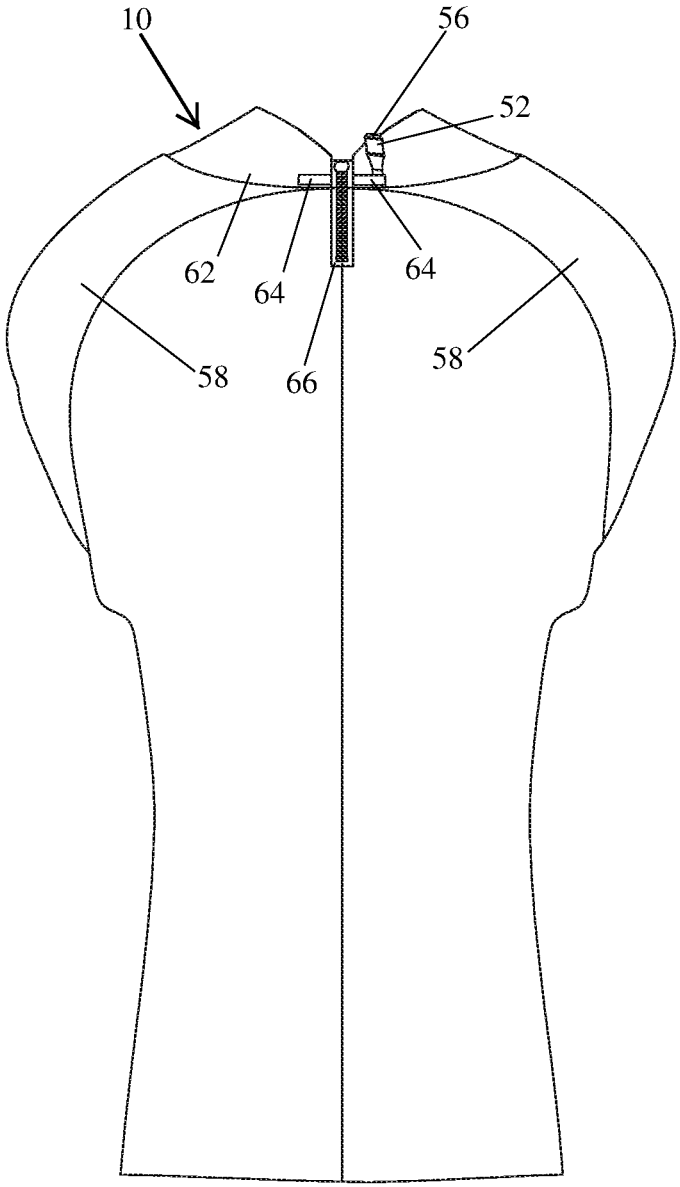
FIG. 3 is an interior view showing the webbing loop and the collar of the compression garment.
Figure 4:
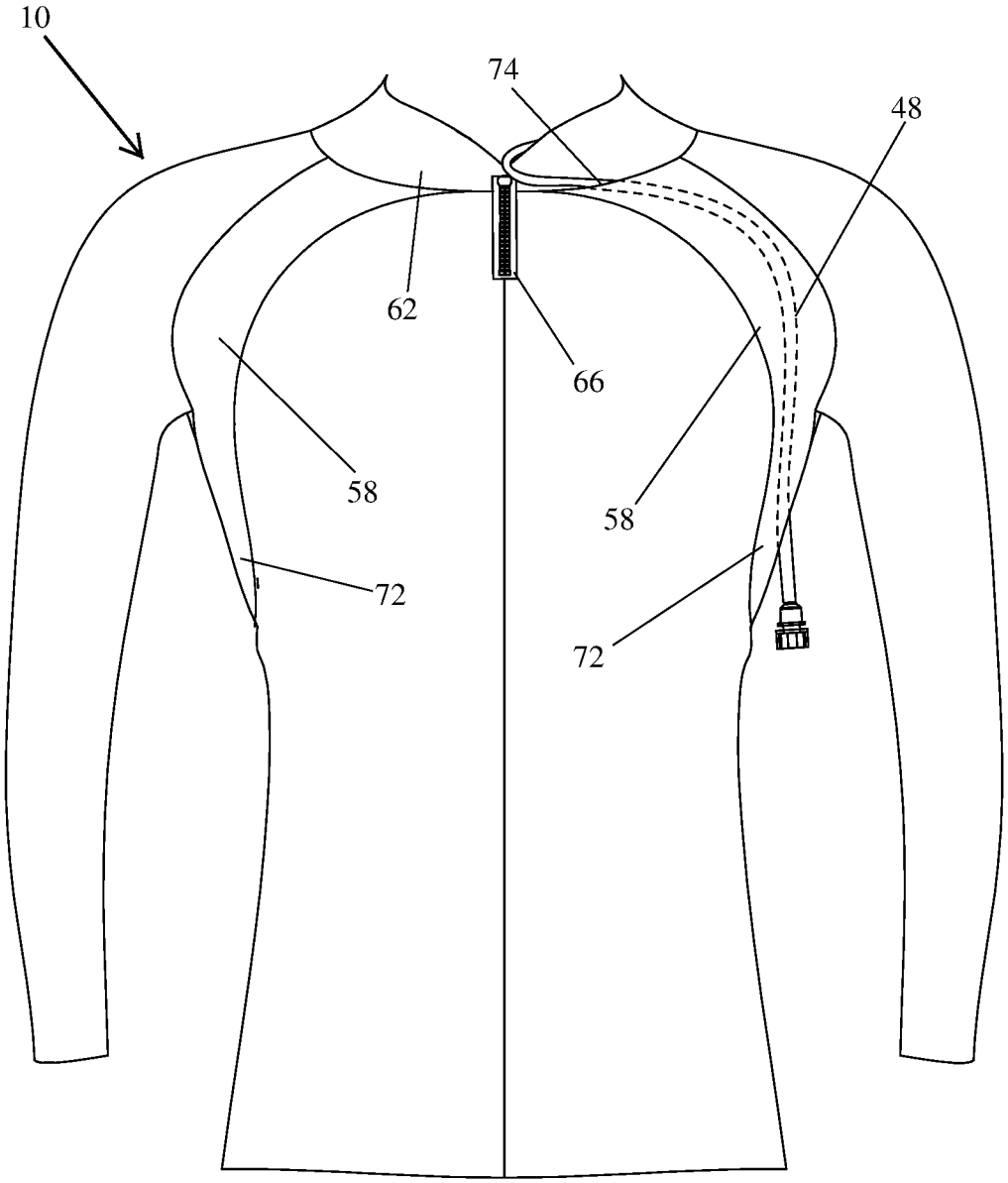
FIG. 4 is a cross sectional interior view of the compression garment showing the routing of the tube along the chest panel and inside of the tube channel.

It is further understood that the compression garment 10 with an integrated receptacle 12 and the method of use thereof may be part of a compression garment 10 and evaluation system which can utilize the operable parts of the compression garment 10 provided herein. For example, FIGS. 1-4 show the interoperability of the various parts of the compression garment 10 for transporting the liquid 14 within the tube channel 72 formed in the chest panel 58. It is understood that various modifications may be made to a compression garment 10 in order to route the tubing of a receptacle 12 and to provide a bite valve 52 or similar mouthpiece on a desired location.

Figure 5:
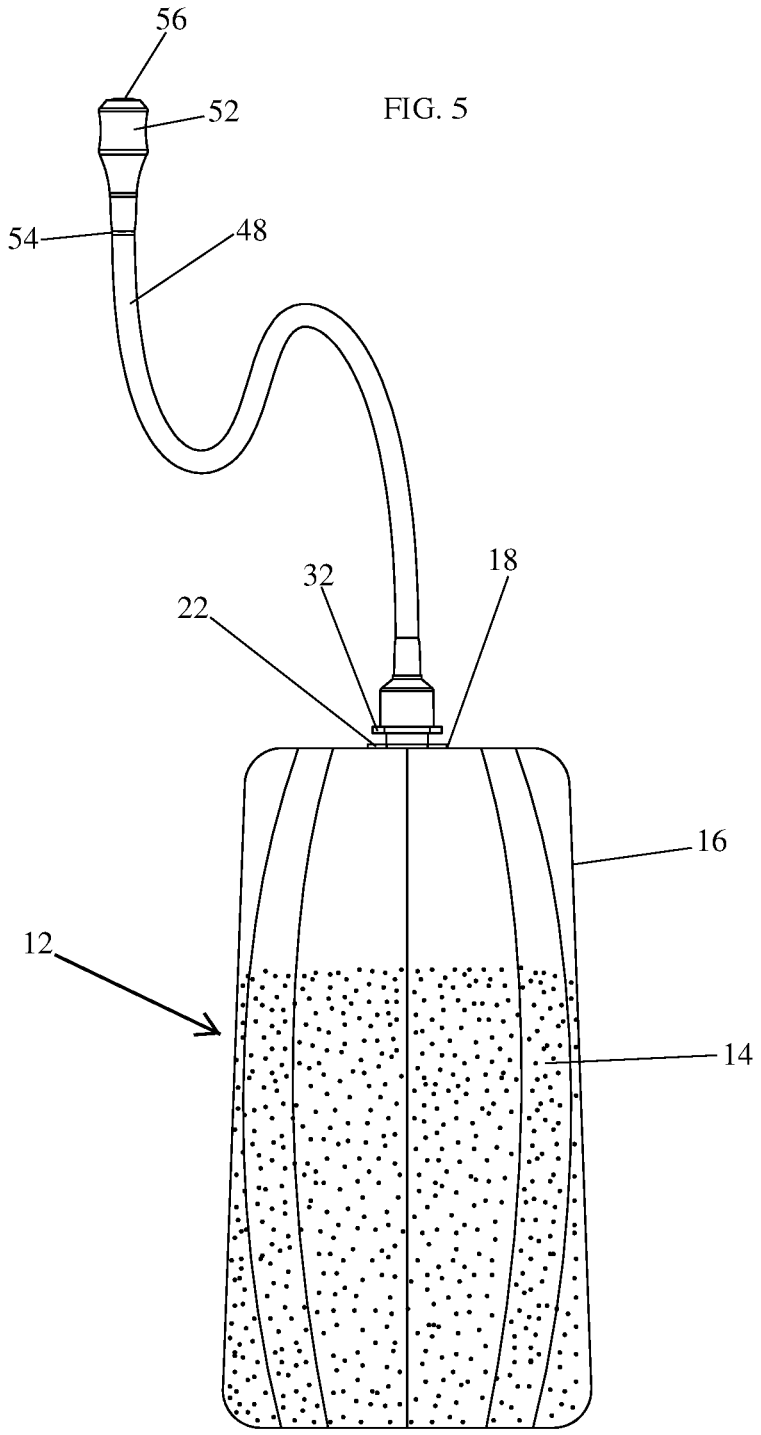
FIG. 5 shows an exemplary receptacle according to a preferred embodiment.
Figure 6:
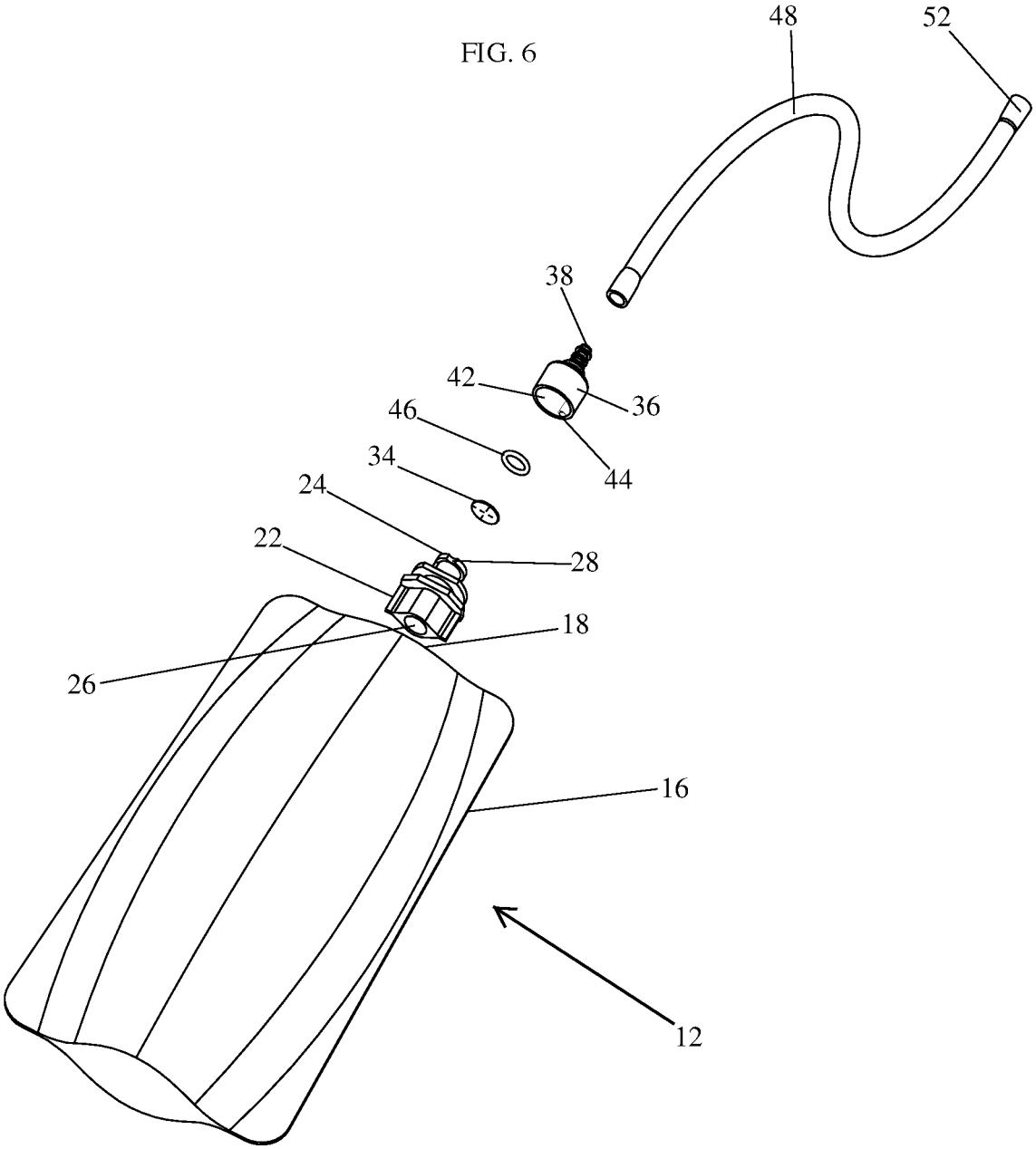
FIG. 6 illustrates the various parts of the receptacle as described herein.
Figure 7:
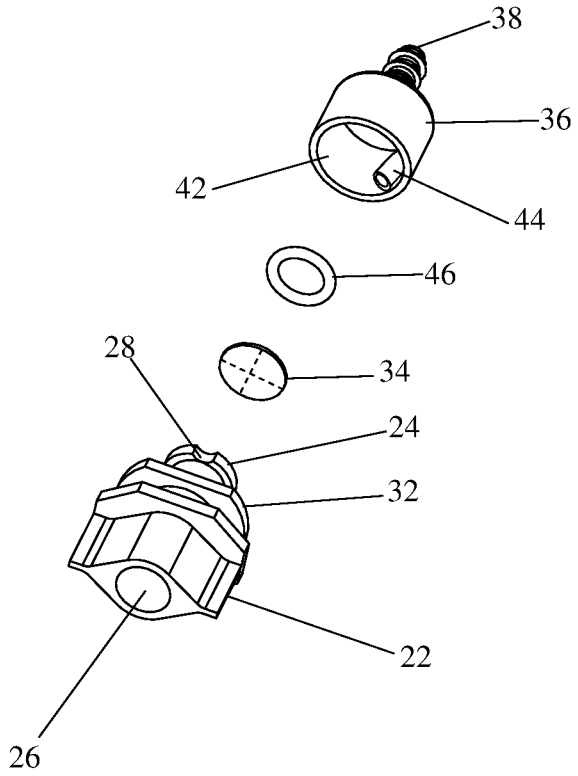
FIG. 7 is an exploded view of the various parts of the receptacle as described herein.
Figure 8:
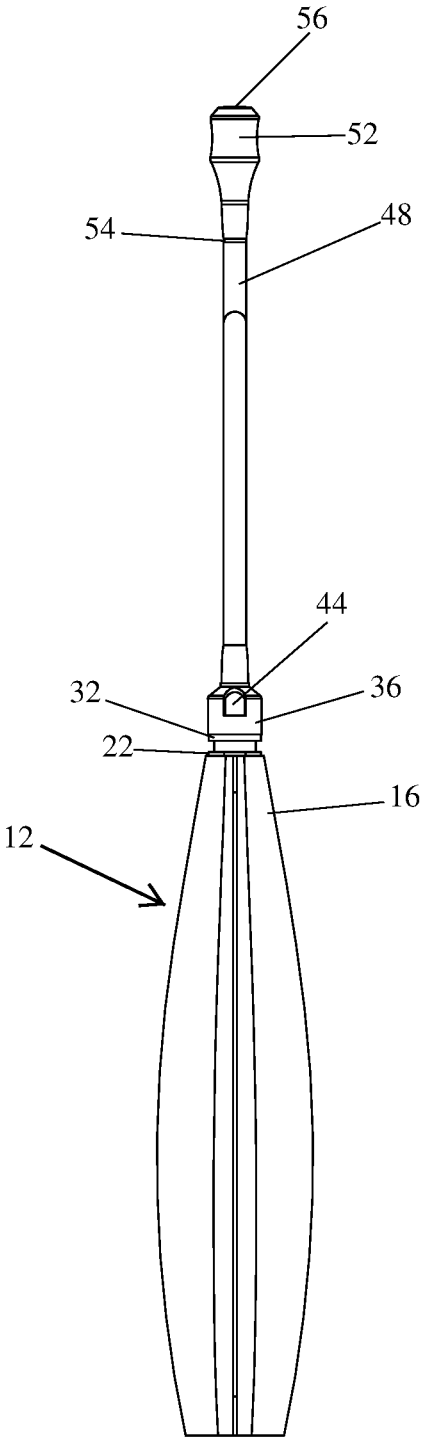
FIG. 8 illustrates a side view of the receptacle.
Figure 9:
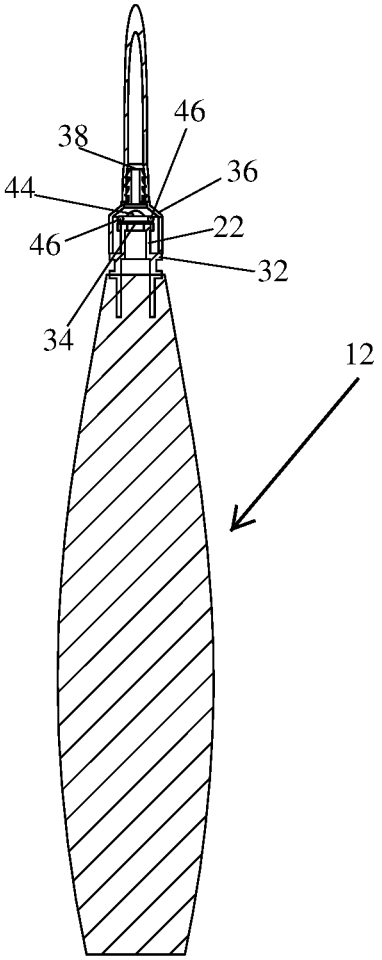
FIG. 9 illustrates cross-sectional view of the receptacle taken along line A of FIG. 10.
Figure 10:
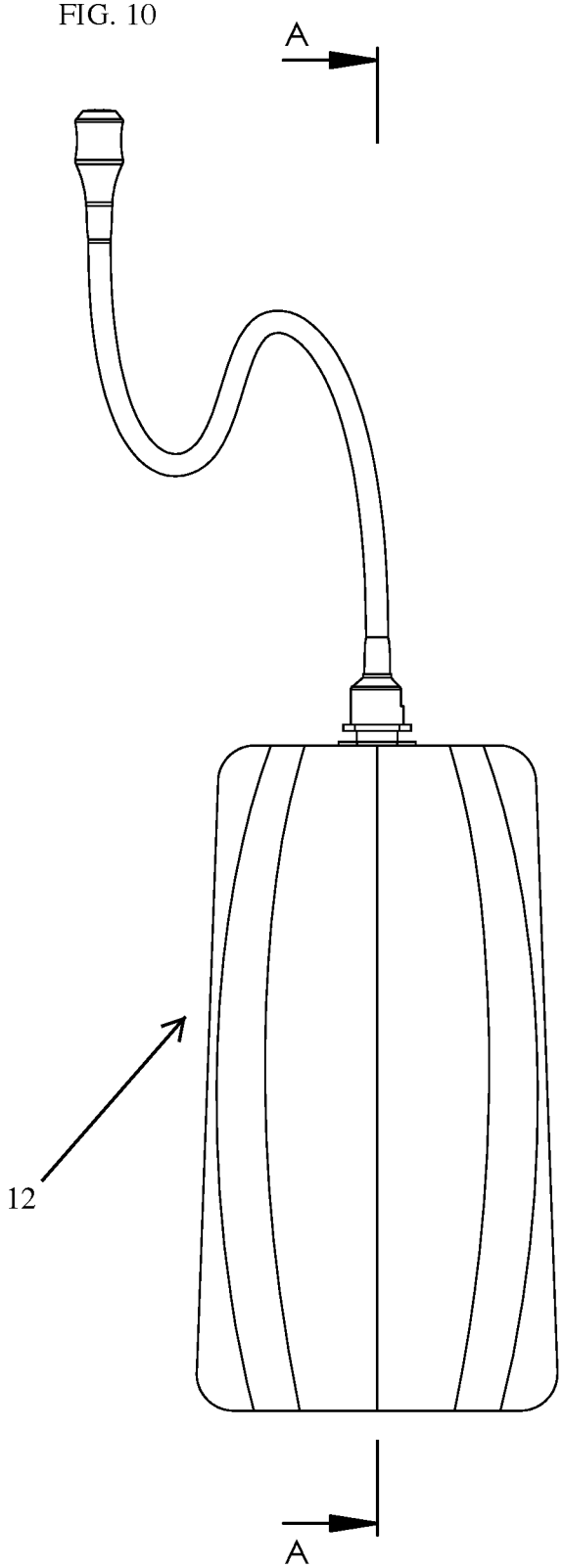
FIG. 10 illustrates a perspective view of the receptacle.
Figure 11:
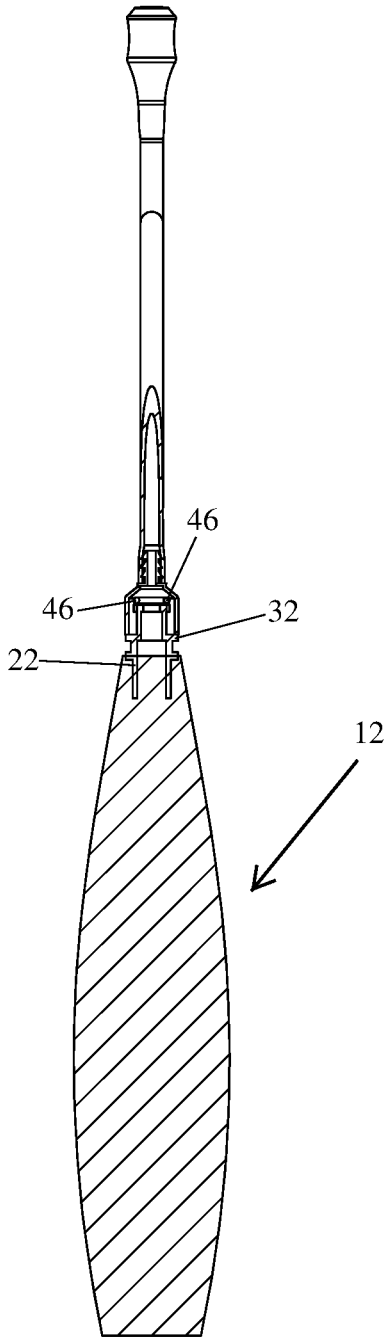
FIG. 11 illustrates cross-sectional view of the receptacle taken along line B of FIG. 12.
Figure 12:
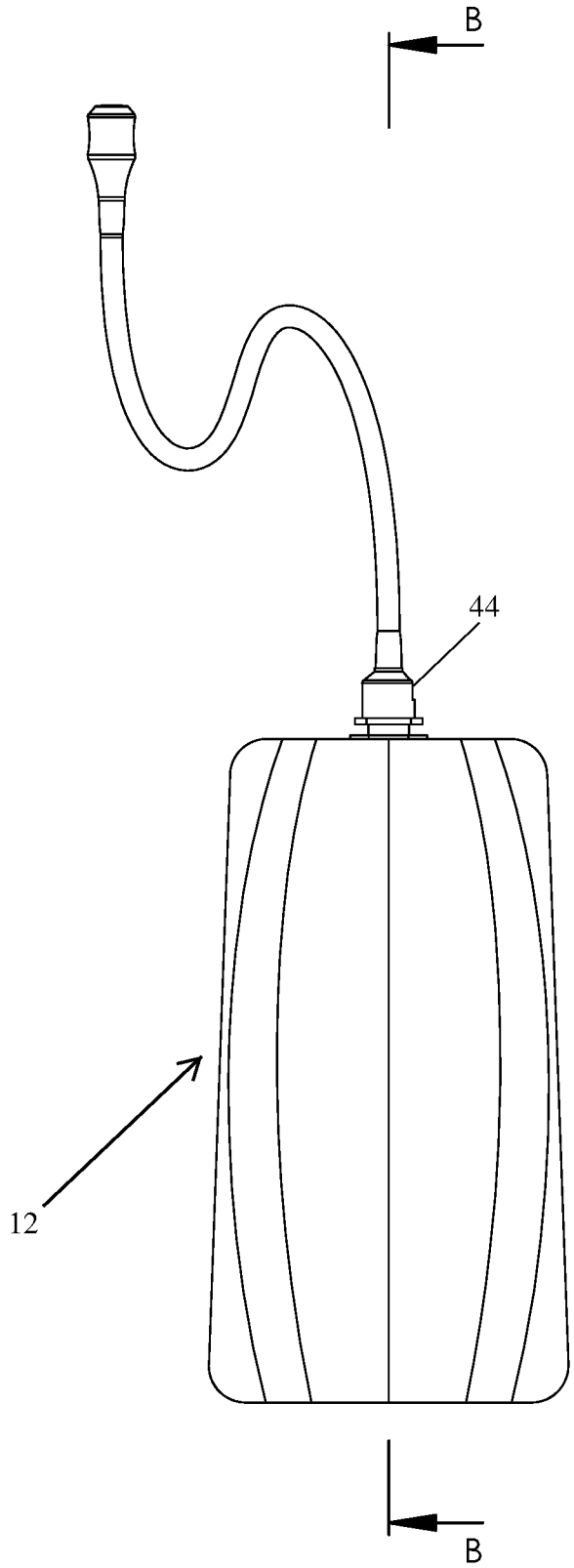
FIG. 12 illustrates a perspective view of the receptacle.

For example, and without limitation, FIGS. 5-12 show a receptacle 12 that provides a liquid 14 to a user. The receptacle 12 has a reservoir 16 with a top opening 18 for receiving the liquid 14, a neck element 22 with top 24 and bottom 26 neck openings and the bottom neck opening 26 being connected to the top opening 18 of the reservoir 16. The neck element 22 has a locking mechanism 28 and a grab ridge 32 connected thereon for removing the receptacle 12 from the cavity of the compression garment 10 and wherein the grab ridge 32 is disposed above the top opening 18 of the reservoir 16. A breakable foil seal 34 covers the top neck opening 24 to prevent the liquid 14 from leaking from the reservoir 16. The receptacle 12 further includes a spout 36 having a top opening 38, a bottom opening 42 and the spout 36 housing a downward extending lever 44 for a locking connection to the locking mechanism 28 of the neck element 22 and an o-ring 46 for locking the breakable foil seal 34 in place on the top neck opening 24. A tube 48 is connected to the top opening 38 of the spout 36 and a bite valve 52 is connected to the tube 48 at a bottom portion 54 thereof and wherein the bite valve 52 has a liquid outlet portion 56 for drawing the liquid 14 from the reservoir 16. The o-ring 46 locks the breakable foil seal 34 in place when the spout 36, is connected to the neck element 22 by turning the spout 36 to secure the downward extending lever 44 of the spout 36 into the locking mechanism 28 of the neck element 22. The locking capabilities of the spout 36 are therefore directed by the neck element 22 having a top opening 24 with the locking element 28 being provided thereon that is either interlocking with the downward extending lever 44 or forced apart from the inside of the spout 36. A user can press and turn the downward extending lever toward the locking mechanism 28 of the neck element 22 and thereby provide the directional force to push the o-ring 46 on the perimeter of the breakable foil seal and provide the positive pressure to prevent the breakable seal 34 from leaking or expelling fluid while in a compressed position in the exterior cavity 68 of the compression garment 10. The downward extending lever 44 having the appearance of an annular groove on the exterior of the spout 36 and extending downward in the interior thereof.

The compression garment 10 having a chest panel 58, a collar 62 with at least one webbing loop 64 being provided for housing the bite valve 52 and at least one fastening device 66 to access the bite valve 52 once the fastening device 66 is opened, at least one exterior cavity 68 for receiving the receptacle 12, and at least one tube channel 72 with tube channel openings 74 for receiving the tube 48 from the exterior cavity 68 and to route the tube 48 to the webbing loop 64.

The tube channel 72 of the compression garment 10 is adapted to allow a user to route the tube 48 into the first tube channel opening 74 upward around the chest panel 58, through the collar 62, and into the webbing loop 64 and wherein the bite valve 52 is housed in the elastic the webbing loop 64.

More or fewer and embodiments can be added to the spout 36 to obtain as much structural and functional support as prescribed by the user. For example, the neck element 22, neck openings 24 and 26, locking mechanisms for the spout 36, and the neck element 22 can be fitted with additional reinforcements and can be constructed in a manner to stabilize the connections while the receptacle 12 is in use. These adjustments would further ensure that the contents in the receptacle 12 are easily accessible and prevent spilling or pouring of the contents. A piercing element can be provided to puncture the breakable foil seal 34 before the spout 36 is locked around the neck element 22 and the o-ring 46 is forced along the top opening 24 of the neck element 22. Piercing holes can be provided on the surface of the breakable foil seal 34 to facilitate the opening thereof.

The receptacle 12 could be generally rectangular in shape and may be formed using manufacturing techniques that are known to construct the same. It may be manufactured from a flexible material, preferably from a laminated plastic material. The outer layer of the receptacle 12 may be constructed in a plurality of colors, patterns, prints, and designs and may include decorative information, such as a logos, trademarks, sports memorabilia, reflective material or the like, to inform the consumer with information regarding the contents of the receptacle 12. The decorative information can be provided based on their relevance in a particular workplace when such design is necessary for recreational, safety, or health reasons. The overall sizes, parts and components, shapes, configurations, material compositions, and dimensions, would be developed during the design and engineering phases, prior to manufacture.

Function and Appealing Features

The potential exists for varying the production of the compression garment 10 and the integrated receptacle 10 in ways that could make it more appealing to a wider range of end users. The appealing features of this device would be its ease of use, sterile presentation, convenience, functionality, safety, and efficiency provided for the user. The inventor is suggesting the compression garment 10 with the integrated receptacle 12 because he believes it would fulfill the need for a modified compression garment 10 with the embodiments that are provided herein. Currently, workout enthusiasts and mature athletes carry bottles while they are exercising in the gym, cycling, or running. The primary hands-free option for hydration is backpack reservoirs that typically are fairly large. Due to the size, weight, and stability of these products, they are much better suited for walking, hiking, and other lower-intensity/impact workouts. This product will provide a new solution for higher-intensity and impact workouts by storing smaller quantities of water tightly against the body to reduce bouncing and interference with the workout.

Production

It appears that the receptacle 10 could be produced easily using conventional and readily available materials and manufacturing processes. No new production technology would be required. This product will consist of a garment component and a liquid receptacle 10 and tune assembly. The first garment offering will be a men's compression shirt, either short or long sleeve (TBD). Liquid bladder should be stored out of the way of typical exercise movements and liquid tubing routed through the garment in such a way to keep tubing under control, comfortable, and out of the way.

The receptacle 10 component should have a low-profile design and store only a small quantity of liquid 14 to prevent it from getting too heavy or bulky. The receptacle 10 should be easy to disconnect and swap when empty. This product is likely going to be used for 30-120 minutes at a time. The liquid receptacle 10 would be swapped in and out during that time frame.

Additional Garment Details:
Tight-fitting/compression garment.
First offering will be a men's garment, either short sleeve or long sleeve.
One pocket for storing a single liquid bladder at a time during use, located out of the way of most common physical movements.
Convenient routing for liquid tubing.
Additional pockets in garment for phones or other items is a nice-to-have.
Receptacle:
Holds approx. 14 oz. of liquid.
Disposable
Slim profile for unobtrusive fit.
Likely a soft material.
Liquid Tubing:
Tube long enough to stretch from bladder to mouth
Valve mechanism to prevent leaks
Mouthpiece User Characteristics
Age range: 18-45
Gender: Men (initially)
User Profile:
Everyday users
Fitness enthusiasts
Amateur athletes; not necessarily pro athletes
Users with an active lifestyle
Users likely to frequent gyms or run for exercise. They would likely use this product only during workouts, not wearing it during casual everyday activities, and would remove the garment/system shortly after finishing a workout.
User Requirements:
Garment is as easy to put on/take off as any typical compression workout garment.
Intuitive installation of liquid tubing into garment.
Easy/intuitive connection/disconnection of liquid tubing to bladder.
Bladder is easy to refill.
Entire system is reasonably easy to clean/sanitize when necessary.

Packaging

The device will require packaging after the manufacturing phase is completed. Package development will include numerous considerations including the necessity for temperature-controlled packaging, protecting the contents inside the receptacle 10 from environmental conditions, flexibility, or the more elaborate packaging designs that are often required for consumer goods. Industrial packaging is primarily concerned with identifying and protecting the product during shipment and storage. The inventor could address the concern for safely packaging and transporting the product as described herein to a large group of individuals who might experience a serious need for the product. Any of the combinations provided herein should successfully encase the receptacle 10 and provide an acceptable shelf life for the same. Accordingly, appropriate labeling could provide the product name, manufacturer, and instructions for use.

A number of illustrative embodiments have been described. Nevertheless, it will be understood that various modifications may be made without departing from the spirit and scope of the various embodiments presented herein. Accordingly, other embodiments are within the scope of the following claims.

What is claimed is:

1. A compression garment with an integrated receptacle that provides a liquid to a user, the compression garment comprising:

the receptacle having a reservoir with a top opening for receiving the liquid, a neck element with top and bottom neck openings and the bottom neck opening being connected to the top opening of the reservoir, the neck element having a locking mechanism, a grab ridge connected thereon and a breakable foil seal covering the top neck opening to prevent the liquid from leaking from the reservoir, a spout having a top opening, a bottom opening and the spout housing a downward extending lever for a locking connection to the locking mechanism of the neck element and an o-ring for locking the breakable foil seal in place, a tube being connected to the top opening of the spout, and a bite valve connected to the tube at a bottom portion thereof and wherein the bite valve having a liquid outlet portion drawing the liquid from the reservoir, the o-ring locks the breakable foil seal in place when the spout is connected to the neck element by turning the spout to secure the downward extending lever of the spout into the locking mechanism of the neck element, the compression garment having a chest panel, a collar with at least one webbing loop being provided for housing the bite valve and at least one fastening device to access the bite valve once the fastening device is opened, at least one exterior cavity for receiving the receptacle, at least one tube channel with tube channel openings for receiving the tube from the exterior cavity and to route the tube to the webbing loop.

2. The compression garment of claim 1 wherein the tube channel of the compression garment is adapted to allow a user to route the tube into the tube channel opening upward around the chest panel, through the collar, and into the webbing loop and wherein the bite valve is housed in the elastic the webbing loop.

3. The compression garment of claim 1 wherein the compression garment routes the liquid from the reservoir to the bite valve.

4. The compression garment of claim 1 wherein the receptacle of the compression garment is removable from the compression garment.

5. The receptacle of claim 1 wherein the liquid provided in the receptacle is drinkable by the wearer.

6. The neck element of claim 1 wherein the grab ridge of the neck element is adapted for receiving the hands of a user and to release the reservoir from the compression garment.

7. A method of providing a compression garment with an integrated receptacle that provides a liquid to a user, the method comprising the steps of, providing the receptacle with a reservoir having a top opening for receiving the liquid, a neck element with top and bottom neck openings and the bottom neck opening being connected to the top opening of the reservoir, the neck element having a locking mechanism a grab ridge connected thereon and a breakable foil seal covering the top neck opening to prevent the liquid from leaking from the reservoir, a spout having a top opening, a bottom opening and the spout housing a downward extending lever for locking connection to the locking mechanism of the neck element and an o-ring for locking the breakable foil seal in place, a tube being connected to the top opening of the spout, and a bite valve connected to the tube at a bottom portion thereof and wherein the bite valve having a liquid outlet portion drawing the liquid from the reservoir, locking the breakable foil seal in place with the o-ring by connecting the neck element to the spout and turning the spout to secure the downward extending lever of the spout into the locking mechanism of the neck element, providing the compression garment having a chest panel, a collar with at least one webbing loop being provided for housing the bite valve and at least one fastening device to access the bite valve once the fastening device is opened, at least one exterior cavity for receiving the receptacle, at least one tube channel with tube channel openings for receiving the tube from the exterior cavity and to route the tube to the webbing loop.

* * * * *